US006712243B2

(12) United States Patent
Rossignol

(10) Patent No.: US 6,712,243 B2
(45) Date of Patent: Mar. 30, 2004

(54) DIAPHRAGM PUMP

(75) Inventor: Eric Rossignol, Chalon sur Saone (FR)

(73) Assignee: Rexam SMT, Tournus (FR)

( * ) Notice: Subject to any disclaimer, the term of this patent is extended or adjusted under 35 U.S.C. 154(b) by 0 days.

(21) Appl. No.: 10/296,211

(22) PCT Filed: May 29, 2001

(86) PCT No.: PCT/FR01/01654

§ 371 (c)(1),
(2), (4) Date: Dec. 2, 2002

(87) PCT Pub. No.: WO01/91913

PCT Pub. Date: Dec. 6, 2001

(65) Prior Publication Data

US 2003/0132252 A1 Jul. 17, 2003

(30) Foreign Application Priority Data

May 30, 2000 (FR) ..... 00 06894

(51) Int. Cl.[7] ..... B67D 5/42
(52) U.S. Cl. ..... 222/207; 222/321.7; 222/256
(58) Field of Search ..... 222/207, 256, 222/321.7

(56) References Cited

U.S. PATENT DOCUMENTS

| | | | | | |
|---|---|---|---|---|---|
| 3,452,905 | A | * | 7/1969 | Micallef | 222/207 |
| 4,033,487 | A | * | 7/1977 | Micallef | 222/207 |
| 4,138,039 | A | * | 2/1979 | Micallef | 222/207 |
| 4,589,573 | A | * | 5/1986 | Tada | 222/214 |
| 5,544,789 | A | * | 8/1996 | Gillingham | 222/207 |

* cited by examiner

*Primary Examiner*—Kenneth Bomberg
(74) *Attorney, Agent, or Firm*—Bacon & Thomas, PLLC

(57) ABSTRACT

The invention provides a pump of the type comprising a body (1) having a bottom portion for communicating with a dip tube (2) via an admission valve and a top portion for connection to the edge of a container (R) and itself containing a metering chamber (10) closed in leaktight manner on top by compression means provided with an exhaust valve and with a return member, and suitable for being actuated by manual thrust being applied to a dispenser head (T) provided with a delivery duct (C), the pump being characterized in that said return member comprises an elastically deformable internal diaphragm (3) carried by the dispenser head (T) and co-operating with a rigid cup (4) fixed beneath said head (T) and co-operating with said diaphragm (3) to define the metering chamber (10).

9 Claims, 2 Drawing Sheets

FIG.2
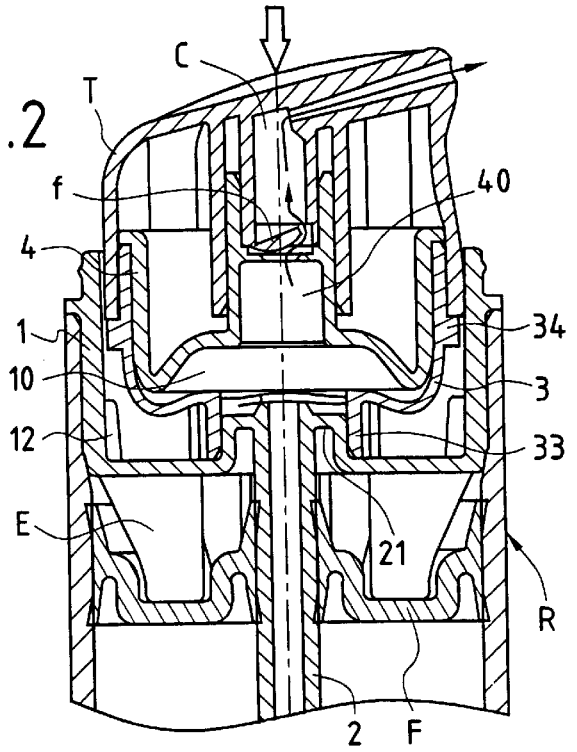
FIG.3
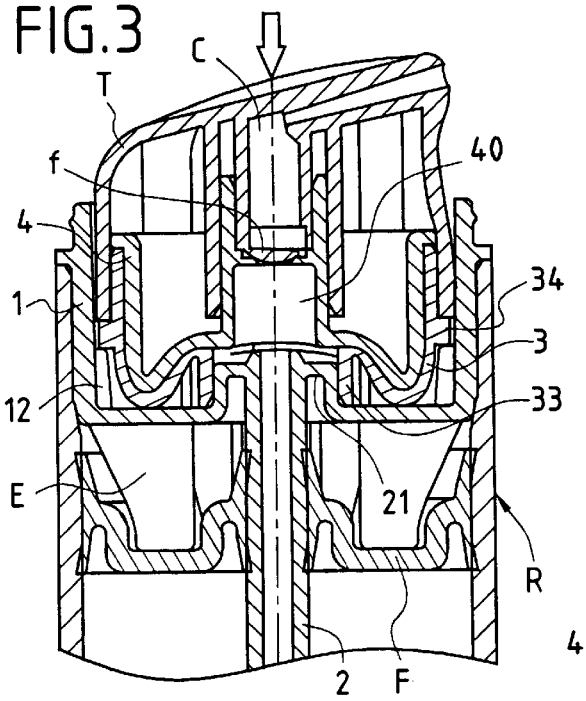
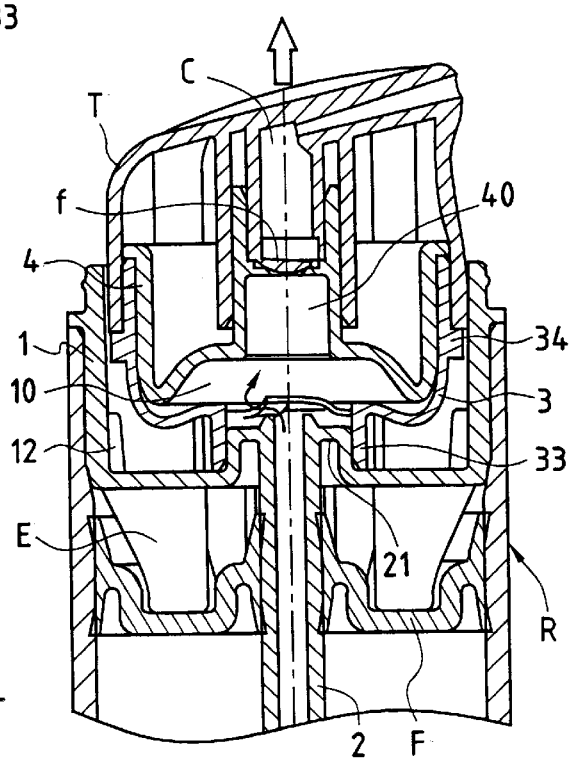
FIG.4

DIAPHRAGM PUMP

The present invention relates to a pump, and more particularly to a diaphragm pump.

As a general rule, a conventional pump comprises a body having a bottom portion for communicating with a dip tube via an admission valve and a top portion for connection to the edge of a container and itself containing a metering chamber closed in leaktight manner on top by compression means provided with an exhaust valve and with a return member, and suitable for being actuated by manual thrust being applied to a dispenser head provided with a delivery duct.

Unfortunately, those pumps require a metal spring to be used for returning the compression means into the high position, and they also require admission and exhaust valves of complex configurations to be made using other metal elements such as balls.

Consequently, those pumps are made up of numerous parts made of various materials so that fabrication and assembly costs are penalizing.

An object of the invention is to solve those technical problems for simplification and cost-reducing purposes, but without compromising the reliability and accuracy qualities of the pump.

In the pump of the invention, said return member comprises an elastically deformable internal diaphragm carried by the dispenser head and co-operating with a rigid cup fixed beneath said head and defining with said diaphragm the metering chamber.

EP-A-0 452 260 discloses a pump having a diaphragm which acts as a return member. The diaphragm covers a rigid cup which defines the bottom of the metering chamber. The dip tube is integral with said rigid cup, a valve being fastened on the top opening of said tube. A plate, fixed under the diaphragm, is in register with the bottom of the chamber.

EP-A-0 951 944 also discloses a pump having a diaphragm which acts as a return member. A tubular element fixed to said diaphragm includes a top portion which extends into the metering chamber and which carries the admission valve at its end, and a bottom portion which is fixed around the dip tube, under the bottom wall of the metering chamber.

The invention seeks to simplify the pump further, without compromising its reliability and accuracy qualities and by reducing the internal volume of the metering chamber when thrust is applied to the dispenser head.

According to the invention, to achieve this object said diaphragm in the free state is of U-shaped section and has a cylindrical socket mounted coaxially and in leaktight manner around the top portion of the dip tube which projects into the metering chamber.

According to an advantageous characteristic, said diaphragm has at least one feed orifice associated with a central solid disk suitable for being pressed in leaktight manner against the top orifice of the dip tube so as to form an admission valve.

In a variant embodiment, the central solid disk is connected to said diaphragm by three radial bridges defining three feed orifices between one another.

According to another characteristic, said rigid cup has a central delivery channel opening out into the delivery duct of the dispenser head via said exhaust valve.

In a specific variant, the bottom edge of said rigid cup is formed with a peripheral collar for bearing in deforming manner against said diaphragm.

According to yet another characteristic, said cup is received at least in part inside said diaphragm.

Preferably, the free edge of said diaphragm is held captive by said cup inside the dispenser head.

According to yet other characteristics, the outside wall of said diaphragm has a peripheral rib serving both to position the bottom edge of the dispenser head and to slide freely relative to the inside wall of the body.

In another specific embodiment, said exhaust valve is constituted by a flexible tongue carried transversely by the bottom end of the delivery duct of the dispenser head.

The pump of the invention presents a structure that is very simple without any metal element.

Only three parts are thus capable of performing the essential functions of the pump.

These parts are made by molding a plastic material and/or an elastomer material and they can be assembled together easily, quickly, and automatically.

The invention will be better understood on reading the following description given with reference to the drawings, in which:

FIG. 2 is a fragmentary section view of the pump of FIGS. 1A and 1B during an initial stage of a dispensing stroke;

FIG. 3 is a fragmentary section view of the FIG. 2 pump during a final stage of a dispensing stroke; and FIG. 4 is a fragmentary section view of the FIG. 2 pump during its stage of returning towards its rest position.

Figure 1A:
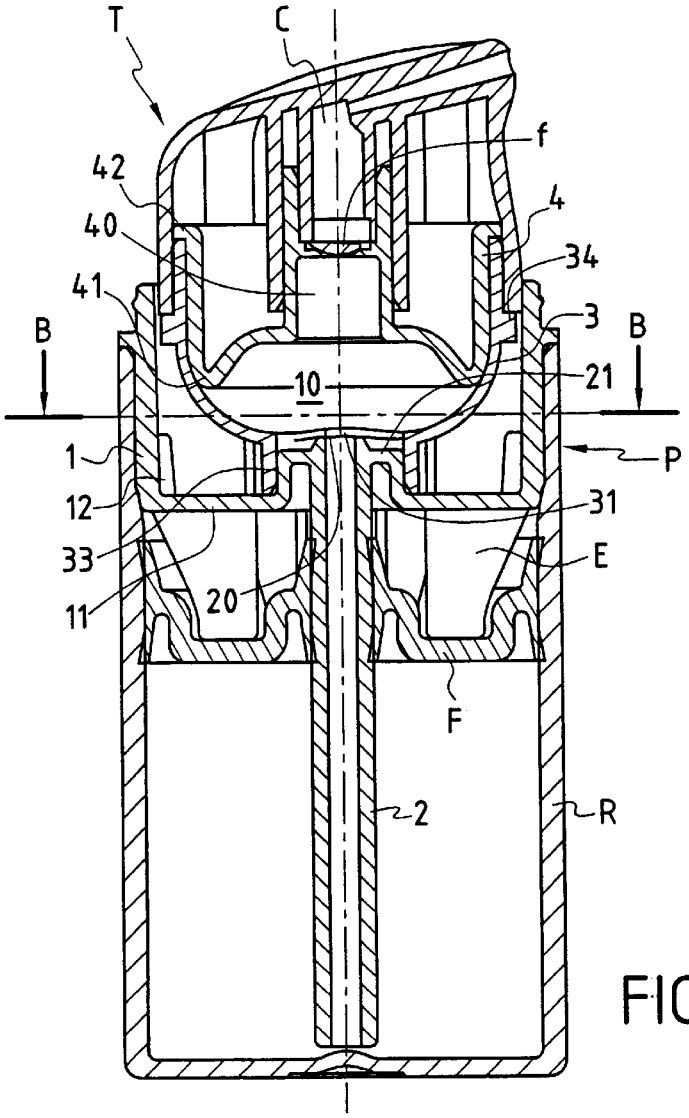
FIGS. 1A and 1B are respectively a vertical section view and a cross-section on B—B of an embodiment of the pump of the invention mounted on a container and shown in the rest position.
Figure 1B:
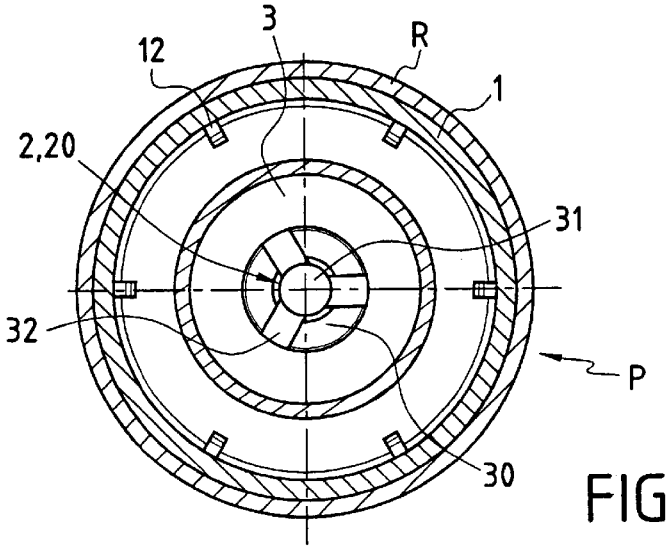

The pump P of the invention shown in FIGS. 1A and 1B is for dispensing liquid or semiliquid substances contained in a container R.

The pump shown is of the "airless" type, i.e. it has no air intake and it is therefore associated with a moving partition F serving both to confine the substance inside the container R and to scrape its inside wall.

The partition F in this example is suitable for moving downwards during successive dispensing stages starting from a high position in which the container R is full, as shown in FIG. 1A.

The pump P comprises a body 1 having a bottom portion for communicating via an admission valve with a tube 2 that dips into the substance, and at its top end it is connected to the top edge of the container R. The body 1 is provided with spacers E blocking upward movement of the moving partition F while the container R is being filled.

The body 1 contains a metering chamber 10 that is closed in leaktight manner on top by compression means provided with an exhaust valve and with a return member. These piston-forming compression means enable pressure to be exerted on the substance filling the chamber 10 on being actuated by manual thrust applied to a dispenser head T covering the pump P and forming a pushbutton, which head is provided with a delivery duct C.

According to the invention, the return member comprises an internal diaphragm 3 made of an elastically deformable material such as an elastomer (silicone, rubber, . . . ) carried by the head T and co-operating with a rigid cup 4 fixed beneath the head T and co-operating with the diaphragm 3 to define the metering chamber 10.

The diaphragm 3 has at least one feed orifice 30 and a central solid disk 31 capable of pressing in leaktight manner against the top orifice 20 of the tube 2, thus forming an admission valve.

In the embodiment shown in FIG. 1B, the disk 31 is connected to the diaphragm 3 by three radial bridges 32 defining three feed orifices 30 between one another.

The diaphragm 3 is preferably made integrally with the bridges 32 and the disk 31.

In the free state, the diaphragm 3 has a cross-section that is substantially U-shaped, defining an upside-down bell and it has a cylindrical socket 33 disposed coaxially and in leaktight manner around the top portion of the dip tube 2 which projects into the body 1.

In the embodiment shown in FIG. 1A, the top portion of the tube 2 is provided with a cylindrical shoulder 21 providing the connection between the bottom 11 of the body 1 and onto which the socket 33 is engaged with leaktight radial clamping.

The rigid cup 4 has a central delivery channel 40 opening out into the delivery duct C of the head T via the exhaust valve. The channel 40 communicates at its bottom end with the metering chamber 10 and is preferably engaged on the duct C of the head T.

In the embodiment shown in FIG. 1A, the cup 4 is received at least in part inside the U-section diaphragm 3.

The bottom edge of the cup 4 forms a peripheral collar 41 designed to apply deforming thrust against the inside wall of the diaphragm 3 as shown in FIGS. 2 and 3 while substance is being dispensed.

The free edge of the diaphragm is held captive by the cup 4 inside the head T.

For this purpose, the free edge of the cup 4 is provided with a transverse rim 42 snapped into a housing of corresponding profile formed in the inside wall of the head T, thereby jamming the diaphragm in interposed manner. In this configuration, the assembly constituted by the head T, the diaphragm 3, and the cup 4 is held in the body 1 solely by the radial clamping action of the socket 33 of the diaphragm 3 on the connection shoulder 21 of the tube 2.

Where appropriate, this connection can be reinforced by heat-sealing or adhesive securing the socket 33 onto the shoulder 21 and/or the bottom wall 11 of the body 1.

The outside wall of the diaphragm 3 has a peripheral rib 34 serving both to define the relative position of the bottom edge of the head T and to slide freely relative to the inside wall of the body 1 allowing air to exhaust freely. The bottom wall 11 of the body 1 is fitted with axial fins 12 constituted end-of-stroke abutments for the rib 34 of the diaphragm 3.

The height of the fins 12 thus determines the maximum degree of deformation of the diaphragm 3 and thus the volume of substance that is dispensed on each actuation.

The exhaust valve is preferably constituted by a flexible tongue f carried transversely by the end of the delivery duct C of the head T.

As shown in FIG. 2, manual thrust applied to the head T drives the cup 4 downwards and deforms the diaphragm 3 inside the body 1.

This reduces the volume of the chamber 10 and puts the liquid substance filling said chamber under pressure. The pressure that exists within the substance causes the tongue f to be shifted towards the inside of the duct C and allows the substance to be delivered as represented by arrows in FIG. 2.

The end of the down stroke of the head T and of the cup 4 corresponds to the rib 34 of the diaphragm 3 coming into abutment against the fins 12 of the body 1.

In this position as shown in FIG. 3, a metered quantity of substance has been dispensed and the diaphragm 3 is constrained to match the outline of the cup 4. The inside volume of the chamber 10 is then reduced to the volume of the delivery channel 40.

Simultaneously, once internal pressure has entered into equilibrium with atmospheric pressure, the tongue f returns to its seat, thereby closing the channel 40.

When manual thrust ceases to be applied, the head T and the cup 4 rise automatically because the diaphragm 3 has been deformed elastically and tends to return like a spring towards its bell-shaped free state (corresponding to its initial shape as shown in FIG. 1A).

As shown in FIG. 4, the upward movement of the head T and the return of the diaphragm 3 towards its rest position is accompanied by the volume of the chamber 10 increasing, thereby establishing suction inside said chamber. This suction causes the admission valve to open by the disk 31 of the diaphragm 3 moving axially towards the inside of the chamber 10.

This displacement of the disk 31 is made possible by the flexibility of the bridges 32 thus allowing substance to be sucked in through the feed orifices 30 until the chamber 10 (including the channel 40) has been completely filled and pressures are again in equilibrium.

Each dispensing cycle is accompanied by a displacement of the moving partition F inside the container R.

What is claimed is:

1. A pump comprising a body (1) having a bottom portion for communicating with a dip tube (2) via an admission valve and a top portion for connection to the edge of a container (R) and itself containing a metering chamber (10) closed in leaktight manner on top by compression means provided with an exhaust valve and with a return member, and suitable for being actuated by manual thrust being applied to a dispenser head (T) provided with a delivery duct (C), said return member comprising an elastically deformable internal diaphragm (3) carried by the dispenser head (T) and co-operating with a rigid cup (4) fixed beneath said head (T) and defining with said diaphragm (3) the metering chamber (10), wherein said diaphragm (3) in the free state is of U-shaped section and has a cylindrical socket (33) mounted coaxially and in leaktight manner around the top portion of the dip tube (2) which projects into the metering chamber (10).

2. The pump according to claim 1, wherein said diaphragm (3) has at least one feed orifice (30) associated with a central solid disk (31) suitable for being pressed in leaktight manner against the top orifice (20) of the dip tube (2) so as to form the admission valve.

3. The pump according to claim 2, wherein the central solid disk (31) is connected to said diaphragm (3) by three radial bridges (32) defining three feed orifices (30) between one another.

4. The pump according to claim 1, wherein said rigid cup (4) has a central delivery channel (40) opening out into the delivery duct (C) of the dispenser head (T) via said exhaust valve.

5. The pump according to claim 1, wherein the bottom edge of said rigid cup (4) is formed with a peripheral collar (41) adapted to bear in a deforming manner against said diaphragm (3).

6. The pump according to claim 1, wherein, said cup (4) is received at least in part inside said diaphragm (3).

7. The pump according to claim 1, wherein a free edge of said diaphragm (3) is held captive by said cup (4) inside the dispenser head (T).

8. The pump according to claim 1, wherein an outside wall of said diaphragm (3) has a peripheral rib (34) serving both to position the bottom edge of the dispenser head (T) and to slide freely relative to the inside wall of the body (1).

9. The pump according to claim 1, wherein said exhaust valve is constituted by a flexible tongue (f) carried transversely by the bottom end of the delivery duct (C) of the dispenser head (T).

* * * * *